US005142115A

United States Patent [19]

Weidman et al.

[11] Patent Number: 5,142,115

[45] Date of Patent: Aug. 25, 1992

[54] APPARATUS FOR LOW RESISTANCE ELECTRIC HEATING OF ELECTRICALLY CONDUCTIVE CONTAINERS

[75] Inventors: Charles R. Weidman; Joan C. Froehle, both of Chatham, Mass.

[73] Assignee: Kilo Alpha Co., Chatham, Mass.

[21] Appl. No.: 609,289

[22] Filed: Nov. 5, 1990

Related U.S. Application Data

[63] Continuation-in-part of Ser. No. 480,185, Feb. 14, 1990.

[51] Int. Cl.[5] ..... H05B 6/10

[52] U.S. Cl. ..... 219/10.491; 219/10.51; 219/10.67; 219/10.75; 392/478

[58] Field of Search ..... 219/10.51, 10.491, 10.75, 219/10.65, 10.67, 10.77, 10.79, 10.57; 392/478

[56] References Cited

U.S. PATENT DOCUMENTS

| | | | |
|---|---|---|---|
| 495,071 | 4/1893 | Thomson | 219/10.51 |
| 1,273,666 | 7/1918 | Powers . | |
| 1,646,599 | 10/1927 | Schaefer . | |
| 1,674,334 | 6/1928 | Jones | 392/478 |
| 2,066,668 | 1/1937 | Bennett | 219/11 |
| 2,381,866 | 8/1945 | Crosby | 219/10.491 |
| 3,354,292 | 11/1967 | Kahn | 219/301 |
| 3,398,262 | 8/1968 | Kahn | 219/301 |
| 3,423,570 | 1/1969 | Trabilcy | 219/301 |
| 3,435,170 | 3/1969 | Smith | 219/10.51 |
| 3,524,966 | 8/1970 | Ando | 219/300 |
| 3,665,154 | 5/1972 | Ando | 219/301 |
| 3,755,650 | 8/1973 | Ando | 219/301 |
| 3,777,117 | 12/1973 | Othmer | 219/300 |
| 3,968,346 | 7/1976 | Cooksley | 219/305 |
| 3,975,617 | 8/1976 | Othmer | 219/300 |
| 3,983,360 | 9/1976 | Offermann | 219/301 |
| 4,214,150 | 7/1980 | Cunningham | 219/518 |
| 4,456,807 | 6/1984 | Ogino et al. | 219/10.77 |
| 4,527,031 | 7/1985 | Aparicio | 219/10.67 |
| 4,560,849 | 12/1985 | Migliori et al. | 219/10.51 |

FOREIGN PATENT DOCUMENTS

| | | | |
|---|---|---|---|
| 1094408 | 5/1955 | France | 219/10.51 |

OTHER PUBLICATIONS

Gear, "Standard Handbook for Electrical Engineers", Fifth Edition, McGraw-Hill Book Company, Section 22-94, pp. 1708-1709, Sep. 1922.

*Primary Examiner*—Philip H. Leung
*Attorney, Agent, or Firm*—Pennie & Edmonds

[57] ABSTRACT

An apparatus for heating a fluid contained in an electrically conductive material container. The apparatus includes a stepdown transformer having a primary winding coupled to source of electric energy and a secondary winding that includes the container itself. In a first embodiment the secondary winding also comprises a substantially rigid electrically conductive member on which the transformer is mounted and electrical contacts at each end of the conductive member for connecting it with the container. In a second embodiment, two semicircular clamps, having articulated jaws, carry the current from the transformer. Such clamps are made to close around the upper and lower portion of the walls of a cylindrical can, completing a secondary winding in which a very high current flows in the walls of the container. In all cases the turns ratio of the transformer is sufficient to reduce the voltage in the secondary winding to a safe level. Illustratively, the turns ratio is at least 100 to 1. Advantageously, the primary winding is connected in series to a thermal cutoff switch which contacts the container. The cutoff temperature of the switch is chosen to cut off power to the transformer before the container becomes too hot. Additionally, the primary winding is also connected serially to a contact switch mounted below the container which closes only when the container is present. Although it is advantageous to use a non-ferromagnetic container such as an aluminum can, this invention can also be practiced utilizing any thin-walled ferromagnetic container.

31 Claims, 2 Drawing Sheets

APPARATUS FOR LOW RESISTANCE ELECTRIC HEATING OF ELECTRICALLY CONDUCTIVE CONTAINERS

CROSS REFERENCE TO RELATED APPLICATION

This application is a continuation-in-part of the applicants' application Ser. No. 07/480,185, filed Feb. 14, 1990, entitled, PIPELINE HEATER, the content of which is expressly incorporated herein by reference.

BACKGROUND OF THE INVENTION

This invention relates to an apparatus for heating the contents in a relatively thin walled electrically conductive metal container such as a standard aluminum can. The device of this invention is useful, for example, for heating fluids, liquids or slurries and formed solids including foods and beverages, medicines, cosmetics, chemicals and other materials while in their metal containers.

It has been known for many years that water or other fluids can be heated with electricity.

One method of heating water or other substances in a container has been the use of a resistance heater. In such a heater, an insulated wire is submerged in the liquid. Electric current flowing through the wire heats the wire which in turn heats the liquid.

Another method that has been used, generally to heat liquids in ferromagnetic pipes such as iron or steel pipelines, is to form an alternating current electric circuit using an insulated conductor that extends a considerable distance along the inside of the pipe. In such a system, the insulated conductor constitutes one leg of the circuit and the pipe itself constitutes the return leg. Examples of such heaters are shown in U.S. Pat. Nos. 3,665,154; 3,983,360; and 3,777,117. These devices require a ferromagnetic conduit and alternating current because the heat effect is generated by magnetic hysteresis as a "skin effect" on the inner surface of the pipe as the polarity of the alternating current changes. These devices also require an insulated conductor extending a considerable length through the conduit and, therefore, need special construction to install the conductor in the pipeline.

In U.S. Pat. No. 3,975,617, it is disclosed that the "skin effect" can be used to heat a conduit without using an interior conductor wire. In that patent it is disclosed that if the insulated wire is affixed to the external surface of an iron or steel pipe, then the alternating current in the return leg through the pipe concentrates in a band on the outer surface of "skin" of the pipe close to the wire thus greatly increasing the heat produced in the pipe wall. No current is carried by the inner wall of the pipe or the part of the outer wall spaced away from the wire of conductor.

Since both of the methods utilizing the A.C. skin effect, i.e., with the conducting wire in the interior or with the conducting wire on the exterior of the conduit, require ferromagnetic conduits, they are of little value in the heating of conventional containers made of non-ferromagnetic materials such as aluminum. Another recognized disadvantage of both these methods is that electricity flows in or through the contents of the container which may produce an electrolytic effect on the contents, generating gases, and creating other similar and harmful contaminating effects.

SUMMARY OF THE INVENTION

We have discovered an efficient means for heating the contents of a metal container. In accordance with the invention the container is connected in an electrical circuit so as to become part of the secondary winding of a stepdown transformer. The primary winding is connected to an alternating current supply such as a conventional household current. Since the container has very little resistance, it is possible to achieve sufficient electric current flow through the container to heat the contents of the can rapidly. Of particular interest, the device can be used to heat fluids, liquids or slurries and formed solids including foods and beverages, medicines, cosmetics, chemicals and other materials while in their metal containers. Although this device is particularly advantageous when non-ferromagnetic containers such as aluminum cans are used, it can also be employed to heat the contents of thin-walled ferromagnetic containers such as conventional steel (so called "tin") cans.

In the preferred embodiment of this invention, a 400 to 1 stepdown transformer is connected to an aluminum container by a pair of clamps. The container and clamps are all electrically conductive and constitute a single turn secondary winding of the transformer. The primary winding is 400 turns of insulated copper wire wrapped around a ferromagnetic core. Advantageously, the primary winding is connected in series to a thermal cut off switch which contacts the container. The cutoff temperature of the switch is chosen so that the switch will cut off power to the transformer before the container becomes too hot. Additionally, the primary winding is also connected serially to a switch mounted below the container which closes only when the container is present.

In one embodiment of the invention, two semi-circular clamps, having articulated jaws, are connected to the low voltage output of the stepdown transformer. Such clamps are made to close around the upper and lower portion of the walls of a cylindrical aluminum can, completing a secondary winding in which a very high current flows in the walls of the aluminum can.

In another embodiment, two projecting annular rings are formed on the wall of a cylindrical aluminum can, one ring near the top and one ring near the bottom of said can. These projecting annular rings provide an electrical contact surface when the rings are inserted into spring-loaded prongs which form the contact source of the current from a low voltage AC transformer recessed into the body of a heating stand.

In still another embodiment of the invention, the container is set upon a metal platform which contacts the bottom rim of the container and a spring-loaded ring is made to contact the upper rim of the container. These two contacts are connected to the secondary outputs of the stepdown transformer and together with the container walls complete the secondary winding.

BRIEF DESCRIPTION OF THE DRAWINGS

These and other objects, features and advantages of the invention will become readily apparent with reference to the drawings and following description wherein.

DETAILED DESCRIPTION OF THE INVENTION

Figure 1:
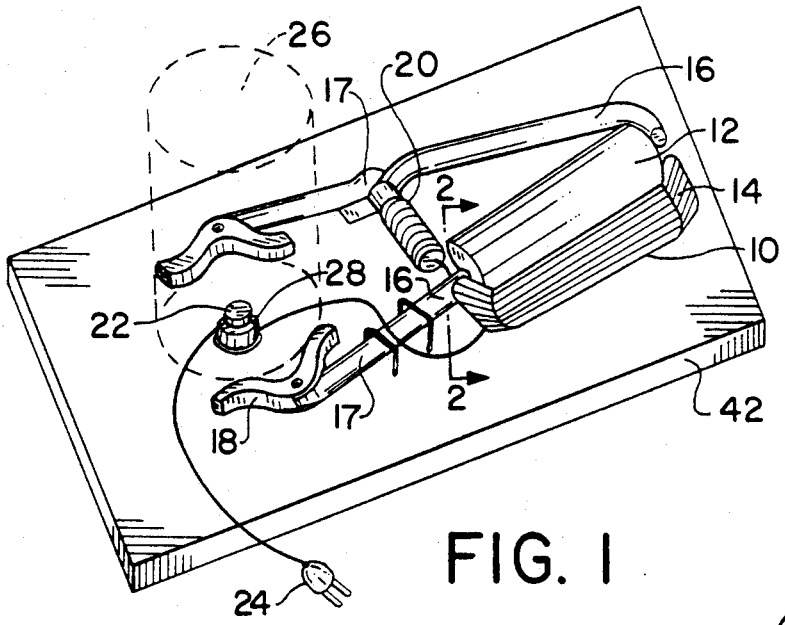
FIG. 1 is a perspective view of a preferred embodiment of this invention.
Figure 2:
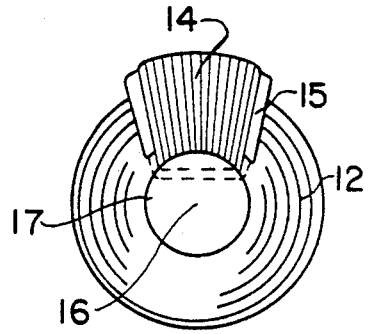
FIG. 2 is a cross sectional view taken along lines 2—2 of FIG. 1.

As shown in FIGS. 1 and 2, the apparatus of the present invention is a stepdown transformer 10 comprising a ferromagnetic core 12, a primary winding 14 and a secondary winding 16. The apparatus is mounted on flat board 42, in this case made of wood. Secondary winding 16 comprises an electrically conductive bar 17, contact jaws 18, and an electrically conductive metal container 26 (shown in phantom), advantageously nonferromagnetic, that is held between the jaws. A spring 20 maintains the necessary contact tension between the jaws and the container. Although under ideal conditions a conventional uninsulated metal spring will not short the contact jaws due to the higher resistance of the spring as compared to the portion of the secondary winding that passes through the container, either the spring or at least one of its mountings should preferably be made of an insulator so as to prevent significant current flow through the spring when the conditions are less than ideal, e.g., where the contact jaws have not made adequate contact with the container or where the resistance of the spring relative to said portion of the secondary winding is too low.

The ferromagnetic core advantageously is a commercially available foil wound toric transformer core. The primary winding 14 illustratively is 400 turns of insulated copper wire wrapped around the ferromagnetic core 12 on an insulated sleeve 15. Advantageously, the primary winding is connected in series to a thermal cut-off switch 22. The cut-off temperature of the switch is set so as to prevent overheating of the container. Additionally, the primary winding is connected serially to a contact switch 28 mounted below the container. The switch closes only when the container rests on the switch. If desired, the trigger point of switch 28 can be adjusted so that current can flow in the primary winding only if the container holds contents having at least a predetermined weight.

The secondary winding is a single turn winding comprising bar 17, which illustratively is made of copper or aluminum, clamps 18 and the container 26 located between the clamps. As shown in FIG. 1, contact jaws 18 advantageously are conductive grounding clamps. Typically, bar 17 is six to twelve inches (15 to 30 centimeters) long so that the device of this embodiment is portable and may be easily installed.

Typically, the source of electric energy is standard household alternating current of 60 cycles and 110 volts; and the primary winding, contact switch 28 and thermal cutoff switch 22 are advantageously connected to a conventional electric plug and cord 24 to permit the heater to be connected to a standard household receptacle. Stepdown transformer 10 reduces this household potential to less than one volt which is accepted as safe under known building codes.

Figure 3:
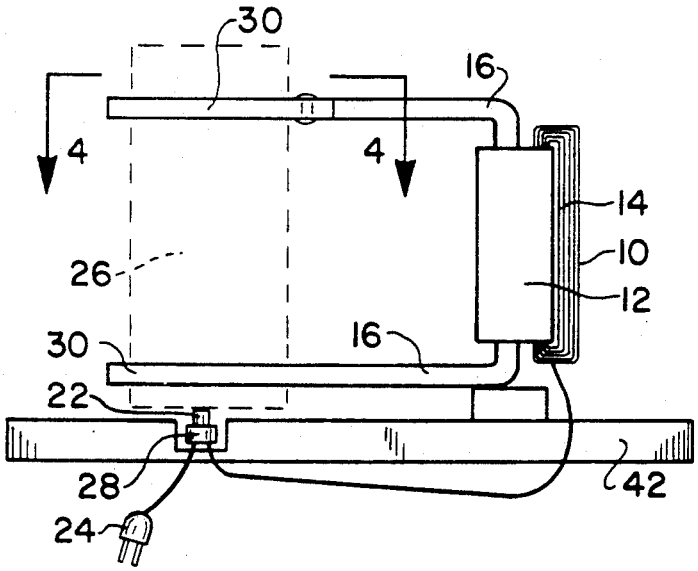
FIG. 3 is a side view of an alternative embodiment of the invention.
Figure 4:
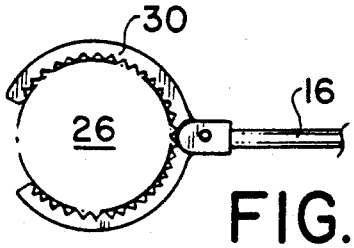
FIG. 4 is a cross sectional view taken along lines 4—4 of FIG. 3.

Another embodiment of the invention is shown in FIGS. 3 and 4. Many of the elements of this embodiment are the same as those of FIG. 1 and bear the same numerical designation. In this embodiment, two semicircular clamps with articulated jaws 30 carry the current from the transformer 10. Such clamps are parallel and shaped to close around the upper and lower portion of the walls of a cylindrical aluminum can so that the longitudinal dimension of the can completes the secondary winding. One such clamp is shown in FIG. 4. Again a very high current can be made to flow in the walls of the aluminum can.

Figure 5:
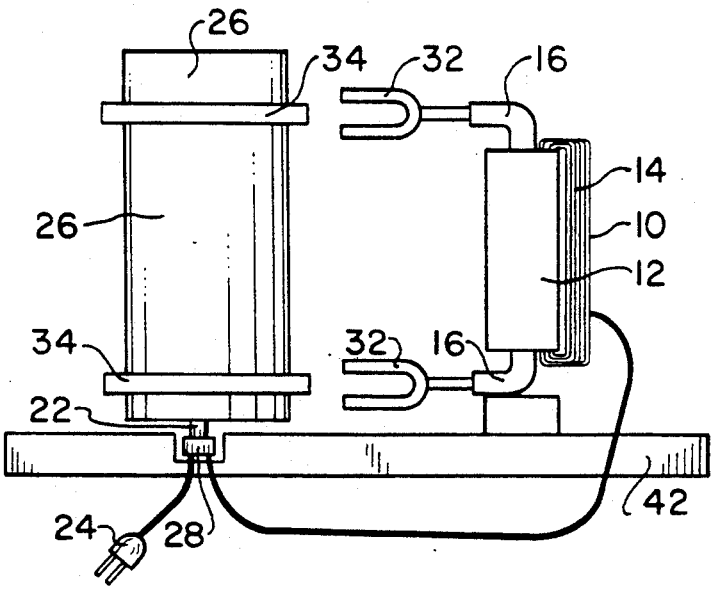
FIG. 5 is a side view of an alternative embodiment of the invention.

Another embodiment of the invention is shown in FIG. 5. Many of the elements of this embodiment are the same as those in FIG. 1 and bear the same numerical designation. In this embodiment, two projecting annular rings 34 are formed on the wall of a container 26, one ring near the top and one ring near the bottom of the container. These projecting annular rings 34 provide an electrical contact surface which can then be inserted into spring loaded prongs 32 to complete the secondary winding of the stepdown transformer 10.

Figure 6:
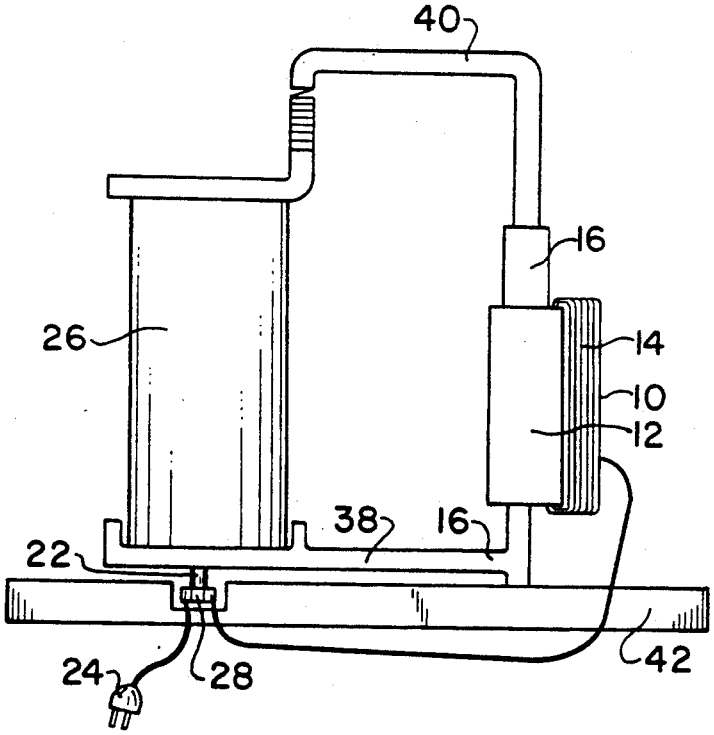
FIG. 6 is a side view of an alternative embodiment of the invention.

Still another embodiment of the invention is shown in FIG. 6. Again, many of the elements of this embodiment are the same as those in FIG. 1 and bear the same numerical designation. In this embodiment, the container 26 is set upon a metal platform 38 which contacts the bottom rim of the container. A spring loaded ring 40 is made to contact the upper rim of the container. Together with the container walls platform 38, ring 40 and bar 17 constitute the secondary winding 16 of the stepdown transformer 10.

In summary then, it has been discovered that the contents of thin walled electrically conductive metal containers can be heated by incorporating the container into the secondary winding of a stepdown transformer. Typically the device is used with an aluminum can to heat foodstuffs, medicines or any other substances contained therein, but can also be used to heat the contents of ferromagnetic containers. The device of this invention heats the contents of the container by providing a high current passing through the thin walls of the container. The device of this invention does not utilize a "skin effect" but rather uses a very low voltage high current directed through a low resistance container to heat the contents rapidly and efficiently.

The invention may be embodied in other specified forms without departing from the spirit or essential characteristics thereto. Transformers having different turns ratios may be used and, in particular, transformers with turns ratios of about 100 or more to 1 will reduce household 110 volts to about 1 volt or less in the secondary. Other types of transformers and arrangements will be apparent to those skilled in the art. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

What is claimed is:

1. An easily attachable apparatus for heating the contents of a variably dimensioned electrically conductive metal container comprising:

a stepdown transformer having:

a ferromagnetic core;

at least one primary winding of said transformer adapted to be coupled to a source of electrical energy; and at least one secondary winding of said transformer having an electrically conductive member and first and second electrically conductive engaging means mounted on and electrically connected to said conductive member for electrically connecting said conductive member to the electrically conductive metal container;

a first means for interrupting the supply of electrical energy to said primary winding when the conductive metal container is not present; and a second means for interrupting the supply of electrical energy to said primary winding when said conductive metal container exceeds a predetermined temperature.

2. The apparatus of claim 1 wherein said ferromagnetic core is a toroid in cross section surrounding a portion of said conductive member.

3. The apparatus of claim 2 wherein the primary winding surrounds a portion of the toroid and extends through its center.

4. The apparatus of claim 1 wherein said secondary winding of said stepdown transformer includes the variably dimensioned electrically conductive metal container wherein said container is made of non-ferromagnetic metal.

5. The apparatus of claim 1 wherein the second interrupting means is a thermal shut-off in the power supply to the primary winding.

6. The apparatus of claim 1 wherein the second interrupting means is mounted so that it thermally contacts the conductive metal container when the conductive metal container is electrically connected to said conductive member.

7. The apparatus of claim 1 wherein said first interrupting means is a contact switch mounted so that it is below the conductive metal container when the conductive metal container is electrically connected to said conductive member.

8. The apparatus of claim 1 wherein the stepdown transformer reduces the voltage in the secondary winding to less than one volt.

9. The apparatus of claim 1 wherein the stepdown transformer has a turns ratio of at least 100 to 1.

10. The apparatus of claim 1 wherein the conductive member has two arms at least one of which is movable toward the other and the means for engagement is a non-conductive spring mounted between said arms.

11. The apparatus of claim 1 wherein the first and second engaging means are conductive grounding clamps.

12. The apparatus of claim 1 wherein the first and second engaging means are semi-circular clamps having articulated jaws.

13. The apparatus of claim 1 wherein the first and second engaging means are spring loaded prongs made to fit into recessed annular rings formed on the wall of the conductive metal container.

14. The apparatus of claim 1 wherein the first engaging means is a metal platform positioned to contact the bottom of the container and the second engaging means is a spring loaded ring positioned to contact the top of the conductive metal container.

15. An easily attachable apparatus for heating the contents of a variably dimensioned electrically conductive metal container having a stepdown transformer with a ferromagnetic core, at least one primary winding adapted to be coupled to a source of electrical energy, and at least one secondary winding, the secondary winding comprising:

an electrically conductive member;

first and second electrically conductive engaging means mounted on and electrically connected to said electrically conductive member; and means for contacting the electrically conductive metal container by said engaging means;

said apparatus further comprising:

a first means for interrupting the supply of electrical energy to said primary winding when the conductive metal container is not present; and a second means for interrupting the supply of electrical energy to said primary winding when said conductive metal container exceeds a predetermined temperature.

16. The apparatus of claim 15 wherein the secondary winding of the stepdown transformer includes the variably dimensioned electrically conductive metal container wherein said container is made of non-ferromagnetic metal.

17. The apparatus of claim 15 wherein the second interrupting means is a thermal shut-off in the power supply to the primary winding.

18. The apparatus of claim 15 wherein the second interrupting means is mounted so that it thermally contacts the conductive metal container when the conductive metal container is electrically connected to said conductive member.

19. The apparatus of claim 15 wherein said first interrupting means is a contact switch mounted so that it is below the conductive metal container when the conductive metal container is electrically connected to said conductive member.

20. The apparatus of claim 15 wherein the stepdown transformer reduces the voltage in the secondary winding to less than one volt.

21. The apparatus of claim 15 wherein the stepdown transformer has a turns ratio of at least 100 to 1.

22. The apparatus of claim 15 wherein the conductive member has two arms at least one of which is movable toward the other and the means for engagement is a non-conductive spring mounted between said arms.

23. The apparatus of claim 15 wherein the first and second engaging means are conductive grounding clamps.

24. The apparatus of claim 15 wherein the first and second engaging means are semi-circular clamps having articulated jaws.

25. The apparatus of claim 15 wherein the first and second engaging means are spring loaded prongs made to be inserted with annular rings formed on the wall of the conductive metal container.

26. The apparatus of claim 15 wherein the first engaging means is a metal platform positioned to contact the bottom of the container and the second engaging means is a spring loaded ring positioned to contact the top of the conductive metal container.

27. An easily attachable apparatus for heating the contents of a variably dimensioned electrically conductive metal container comprising:

a stepdown transformer having:

a ferromagnetic core;

a turns ratio of at least 100 to 1;

at least one primary winding adapted to be coupled to a source of electric energy;

at least one secondary winding having:

an output voltage of less than one volt;

an electrically conductive member having two arms at least one of which is movable toward the other, said arms being connected by a non-conductive spring mounted between said arms; and a first and second easily attachable electrically conductive engaging means mounted on and electrically connected to said conductive member for electrically connecting said conductive member to the electrically conductive metal container wherein said two arms and said non-conductive spring mounted between said arms maintain contact between said contacting means and said electrically conductive metal container;

a thermal shut-off switch in contact with said electrically conductive metal container for interrupting the supply of electrical energy to said primary winding when said conductive metal container exceeds a predetermined temperature; and a contact switch mounted below said conductive metal container for interrupting the supply of electrical energy to said primary winding when said conductive metal container is not present.

28. The apparatus of claim 27 wherein the first and second electrically conductive contacting means are conductive grounding clamps.

29. The apparatus of 27 wherein the first and second electrically conductive contacting means are semi-circular clamps having articulated jaws.

30. The apparatus of claim 27 wherein the first and second electrically conductive contacting means are spring loaded prongs made to fit into recessed annular rings formed on the wall of the conductive metal container.

31. The apparatus of claim 2 wherein the first electrically conductive contacting means is a metal platform contacting the bottom of the container and the second electrically conductive contacting means is a spring loaded ring contacting the top of the conductive metal container.

* * * * *